United States Patent [19]

Levine

[11] 4,035,402

[45] July 12, 1977

[54] DEWAXING PROCESS FOR VEGETABLE OILS

[75] Inventor: Leon Levine, Wayzata, Minn.

[73] Assignee: The Procter & Gamble Company, Cincinnati, Ohio

[21] Appl. No.: 618,092

[22] Filed: Sept. 30, 1975

Related U.S. Application Data

[63] Continuation-in-part of Ser. No. 559,625, March 17, 1975, abandoned, which is a continuation of Ser. No. 345,607, March 28, 1973, abandoned.

[51] Int. Cl.[2] ..... C11B 3/06

[52] U.S. Cl. ..... 260/425

[58] Field of Search ..... 260/425

[56] References Cited

U.S. PATENT DOCUMENTS

| | | | |
|---|---|---|---|
| 2,223,077 | 11/1940 | Stadt | 260/425 |
| 2,564,407 | 8/1951 | Parkin et al. | 260/425 |
| 2,686,796 | 8/1954 | Markley et al. | 260/425 |
| 2,752,378 | 6/1956 | Julian et al. | 260/425 |
| 3,102,898 | 9/1963 | Schmitt | 260/425 |

OTHER PUBLICATIONS

Rini; S. J.—"Refining, Bleaching, Stabilization, Deodorization, and Plasticization of Fats, Oils, and Shortening"—J.Am.Oil Chemists' Soc. 37—pp. 512–520, Oct. 1960.

Kirk–Othmer–Encyclopedia of Chem. Tech., vol. 8, pp. 786, 800.

Hackh's Chemical Dictionary — p. 26, "Alkali" Definition.

*Primary Examiner*—Helen M. McCarthy
*Attorney, Agent, or Firm*—Louis G. Xiarhos

[57] ABSTRACT

This invention relates to an improved process for dewaxing vegetable oils containing free fatty acid impurities, wax and other insoluble matter, which comprises: chilling a refined and water-washed or filtered vegetable oil, mixing the chilled vegetable oil with a dilute alkaline solution; gently agitating the resulting mixture, centrifuging the mixture and separating a heavy phase which contains wax and other impurities from a light phase which may then be bleached and deodorized to form a clear oil. The invention further relates to a reliable process for producing salad oils and other clear oils which remain clear at ambient to refrigerator temperatures.

14 Claims, No Drawings

DEWAXING PROCESS FOR VEGETABLE OILS

REFERENCE TO COPENDING APPLICATION

This application is a continuation-in-part of commonly-assigned and now abandoned application Ser. No. 559,625, filed Mar. 17, 1975, and which in turn is a continuation of commonly-assigned and now abandoned application Ser. No. 345,607, for "Improved Dewaxing Process For Vegetable Oils", filed Mar. 28, 1973 in the name of Leon Levine.

BACKGROUND OF THE INVENTION

This invention relates to an improved process for dewaxing vegetable oils and, more particularly, to a process in which consistently efficient separation of undesirable waxes can be achieved for oils such as sunflower, safflower, and corn oil. Vegetable oils, and more particularly edible vegetable oils, are used as salad oils, cooking oils, margarine constituents, and the like. Safflower, sunflower and corn oil in particular are oten used in these and other food applications.

For purposes of this application the terms "wax" and "high melting material" are used interchangeably and are intended to be generic to the many substances which can cause clouding in oils at temperatures of less than about 60° F.

A problem which arises in the purification of vegetable oils is that the crude oils tend to have high contents of undesirable unsoluble material. Natural vegetable seed oils are composed of mixtures of many naturally produced chemical compounds including not only the oily constituents, but also usually, small percentages of natural phosphatides, vegetable waxes, pigments, and many other compounds. The oily constituents, namely the glyceride esters of the long chain fatty acid of the saturated and unsaturated types make up the largest fraction of vegetable oils. Such materials to a large extent determine the properties of the oil, but the remaining constituents also exert a marked and sometimes detrimental effect, depending upon the use to which the oil is put.

Some natural vegetable oils of commercial grade such as safflower, sunflower, cottonseed oil, soybean oil, peanut oil and corn oil become cloudy after having been chilled or cooled to somewhat lower than room temperatures as in a refrigerator and remain cloudy when returned to ordinary (room) temperatures. The cloudiness may be followed by a settling out of an opaque layer, a particularly disadvantageous occurrence when the oil is packed in glass and where clarity and brightness are of importance.

A large portion of the high melting material can be removed from oils by a process known as "winterizing" in which the oils are carefully cooled to low temperatures for extended periods of time to permit precipitation of solid material. Solid material can then be removed by pressing or other separation procedures. However, not all of the high melting solid material is removed from oils by winterizing, and the oil still tends to cloud when stored for extended periods of time at low temperature. Moreover, the usual winterizing treatment undesirably tends to remove by entrainment a substantial portion of the olein fraction of the oil.

The process of this invention presents a process for producing a salad oil which remains clear at ambient to refrigerator temperatures. This process is useful for processing oils which contain waxes such as sunflower, safflower, or corn oil. A number of oils such as those mentioned above contain small quantities of waxes which are derived from the seed coats during crude oil extraction. These waxes precipitate at room temperatures or lower, making the oils unsuitable for use in salad oils. In the past these waxes have been partially removed by expensive processes involving low temperature crystallization and filtration at very slow rates.

The dewaxing process of this invention is useful primarily for oils which have been previously refined and either water-washed or filtered. It is important that the oils have a low fatty acid content of less than about 0.1% and in addition the oils should have a low soap content of less than about 0.1%. The use of normal crude oils in the process of this invention is practically impossible because of the many impurities present.

Many previous attempts have been made to remove wax fractions from crude vegetable oils by mechanical separation such as centrifuging and filtration at low temperatures. These techniques have been unsuccessful due in part to the small differences in specific gravity between the wax and the vegetable oil and also due to the compaction of the vegetable oil wax under pressure in a filter to a slime or grease consistency which resists the passage therethrough of the vegetable oil.

Refining techniques previously in general use, such as alkali treatment of oil, will not remove wax from vegetable oils sufficiently to eliminate the cloudy appearance of the oils due to the presence of wax, particularly at lower temperatures. Treatment of vegetable oils with bleaching earth reported as an effective method of removing mucilaginous materials is not effective at low temperatures, as the slimy nature of the vegetable oil wax prevents satisfactory removal of the treatment material. Another common approach to refining of oils is the hydration of gumming material, making them insoluble. However, addition of water to vegetable oil per se does not render the wax any more oil insoluble or more readily recoverably by any mechanical methods.

In view of the above, it is an object of this invention to provide an improved process for the dewaxing of refined and water-washed or filtered vegetable oils.

It is a further object of this invention to provide a dewaxed vegetable oil which is suitable for use as a salad oil after it has been bleached and deodorized.

It is an additional object of this invention to provide a dewaxed vegetable oil having excellent refrigerator clarity of greater than 100 hours at 32° F and greater than 2 weeks at 40° F.

These and other objects will become apparent from the discussion below.

SUMMARY OF THE INVENTION

According to the present invention a refined and waterwashed or filtered vegetable oil having a low fatty acid content and a low soap content is chilled to a temperature of less than 60° F and held for a time period of greater than 1 hour. The resulting chilled vegetable oils is mixed with a dilute alkali solution and subjected to mild agitation for at least ½ hour. The mixture is then centrifuged which causes separation into a heavy phase containing the wax of the natural vegetable oil and a dewaxed light phase which may be later bleached and deodorized to form an improved clear oil, i.e. salad oil.

DETAILED DESCRIPTION OF THE INVENTION

This invention comprises a process for dewaxing a vegetable oil by successively chilling, diluting with an alkali solution, agitating, centrifuging, separating and finally bleaching and deodorizing to provide a finished salad oil.

Oils which are suitable for salad use frequently are stored in refrigerators. The prolonged cooling of such oils to temperatures normally encountered in refrigerators such as from about 30° to about 50° F generally results in the deposition of crystalline material, usually solid triglycerides or waxes (linear esters) from the oil. This material may appear in the form of a cloud, or as clusters of crystals and is considered objectionable by the housewife. In general, the tendency to form solid triglycerides in oils also adversely affects the suitability of the oil for use in mayonnaise emulsions. Mayonnaise emulsions prepared from such oils tend to be unstable at low temperatures and are more easily broken.

The process of this invention, a procedure known as "dewaxing", has been developed to process those oils which contain waxes which precipitate at refrigerator temperatures. The most common of such oils are sunflower, safflower and corn oils, although many other vegetable oils encounter similar problems. As mentioned previously, it is necessary for the practice of the present invention that the oil to be dewaxed have a low soap content and a low free fatty acid content in addition to being refined or water-washed. The low soap and fatty acid content of course are a direct result of the refining and/or water washing procedures. More particularly, a refining procedure which has been found suitable for the practice of this invention is described in U.S. Pat. No. 3,102,898 (1963) issued to Schmitt and entitled "Process for the Purification of Glyceride Oils".

"Refining" is commonly referred to as the removal of gross impurities, gummy or mucilaginous material and the free fatty acids from oils and as herein used the term excludes "bleaching" (color removal) and odor removal. Known methods of refining include contacting the oil with strong or dilute alkaline material followed by separation of impurities, by liquid-liquid extraction of impurities from the oils, or by some form of steam distillation, and/or by contacting the glyceride oils with acids. The ultimate objective of a refining operation is to remove every undesirable impurity completely, while at the same time maintaining intact all of the desirable oil. The particular process used with a given oil is determined by the foregoing consideration of maximum impurity removal with a minimum of oil loss.

Crude vegetable oils will typically contain a mixture of naturally produced materials such as free fatty acids, phosphatides, pigments and the like and these compounds will be removed in part by conventional, e.g., alkali, refining operations. The extent to which these impurities are removed by a refining operation can be conveniently expressed in terms of the amount of free fatty acid or soap present in a refined oil in relation to the content of such materials in the corresponding crude oil.

Frequently, it will be difficult to measure the concentration of certain impurities which may even be of undetermined constitution and it will be convenient to express their removal during refining by reference to the amount of free fatty acid or soap removed from the crude oil. Thus, it will be appreciated that degree of refining can be expressed in terms of a fatty acid or soap specification recognizing that the refining operation will have removed from the crude oil impurities in addition to free fatty acids and that the expression of free fatty acid or soap content reflects the extent to which impurities in general are removed from a crude vegetable oil.

The vegetable oil after refining and/or water washing operations must contain less than about 0.1% of free fatty acids and preferably from about 0.01 to about 0.05%. In addition the soap content must be less than about 0.1% and preferably less than about 0.05%. It has been shown that if the limits of either of these ranges are not observed an almost inseparable emulsion forms upon dewaxing with an alkali solution.

The refined and/or water washed oil is then chilled using standard chilling apparatus to less than 60° F. and held at these chilled temperatures for longer than 1 hour. A preferred range of chilling temperatures is from about 30° to about 50° F. Optimum results are obtained by chilling the oil to 40° F.

Upon completion of chilling an alkali solution is added amounting to from about 10 to about 30% by weight of the total mixture of oil and alkali solution. Any of a variety of alkaline materials can be used for this purpose. A preferred alkaline material is sodium hydroxide although others are viable substitutes. Suitable alkali solutions for purposes of this invention include, but are not limited to sodium hydroxide, sodium bicarbonate, sodium carbonate, calcium hydroxide, potassium hydroxide, magnesium hydroxide, ammonia, and some organic alkalies.

Examples of suitable organic alkaline compouds include the water-soluble soaps of fatty acids such as the alkali metal (e.g., sodium, potassium), ammonium or substituted-ammonium (e.g., alkanol-amine) salts of saturated or unsaturated fatty acids. The employment of an aqueous solution of a soap material constitutes a preferred practice from the standpoints of desirable chill test results and neutral oil losses. Since the formation of soap by reaction of alkali such as sodium hydroxide and neutral oil is minimized by addition of a soap material, losses of neutral oil are avoided. Thus, addition of soap in contrast to an in situ formation of soap constitutes a preferred practice. Soaps of fatty acids of from 8 to 22 carbon atoms, and preferably from 12 to 18 carbon atoms, are suitable. Preferably the soap materials will be soaps of fatty acids corresponding in chain length to the acyl groups of the glyceride oils treated in accordance with the invention. Thus, soaps of sunflower, safflower or corn oil fatty acids can be employed although soaps of tallow fatty acids, coconut fatty acids and other fatty acids of like edible fats can be suitably employed. Alkali metal soaps of oleic acid, e.g. sodium or potassium oleate are preferred and provide desirable wax removal results combined with minimal oil losses.

When sodium hydroxide is used as the alkali material it must be mixed to a concentration within the range of from about 1.0 to about 2.5% by weight of lye in water. This concentration range is important as above 2.5% and below 1.0% chill test results are unsatisfactory. It will be appreciated that solutions of other alkali agents can be suitably employed although they will be used in different amounts or concentrations depending upon solubility, stoichiometry and nature of the particular alkali employed.

The chilled oil and alkali solutions are then mixed with gentle agitation. The alkali solution is added until it forms from about 10 to about 30% by weight of the total mixture. A preferred range is from about 15 to about 25%. Agitation may be provided by any suitable means although rotary mixers operating to provide low shear and high circulation are preferred, i.e. Twin 6 inch Marine impellers operated at 100 rpm. The agitation must be strong enough to uniformly disperse the alkali solution without, at the same time, forming an inseparable emulsion. The alkali solution is kept in contact with the oil for a minimum of ½ hour. If high shear mixing is employed the alkali solution and the oil form a virtually inseparable emulsion making further separation difficult. The low shear-high circulation mixing necessary for the practice of this process is normally provided by operating rotary mixers having relatively large blades at a relatively low speed (rpm). As mentioned previously, Twin 6 inch Marine impellers operated at 100 rpm provide the necessary low shear-high circulation mixing to avoid creating an inseparable emulsion of the oil-alkali mixture. The actual rotary mixer used is not critical as long as the blade size, speed (rpm) and container size are combined to give low shear and high circulation.

The mixture is then centrifuged using continuous centrifugation apparatus. A heavy phase (overflow) and light phase (underflow) are formed. The heavy phase contains the wax and other impurities while the light phase is clear. The light phase may then be further processed to form a salad oil, clear cooking oil or whatever product is desired. Separation into the layers is very distinct with less than 1.5% by weight of the desirable oil being lost with the heavy phase. Likewise, the amount of unremoved impurities is low being in the range of less than 0.03% soap and less than 0.3% water in the light phase. These levels are judged to be satisfactory. The clear oil resulting from this invention after drying and bleaching exhibits excellent chill test results as evidenced by refrigerator clarity of longer than 100 hours at 32° F and longer than 2 weeks at 40° F. These oils may then be bleached and deodorized and used in the formation of edible products such as salad oils.

A bleaching operation suitable for practice of this invention is described in U.S. Pat. No. 3,673,228 (1972) issued to Harris and Levine and entitled "Process For Adsorbent Bleaching of Edible Oils". In a typical bleaching process the dewaxed oil is mixed with adsorbent. This mix is heated, maintained in heated condition for a period of time, and then filtered to separate the spent adsorbent and decolorized oil. Traditionally, much of the bleaching action occurs during the filtering process because of the high concentration of bleaching adsorbent compared to oil which can be present in this process.

In addition, a deodorization operation as described in U.S. Pat. No. 3,506,969, issued to Baker et al. and entitled "Continuous High Temperature Steam Deodorization of Edible Oils" can be used to deodorize oils. Steam deodorization of edible oils is removal, by various kinds of steam contacting, of free fatty acids and volatile odoriferous and flavorous materials which are responsible for the smell and taste of undeodorized oil.

Upon completion of the above-mentioned bleaching and deodorization operation a finished salad oil is obtained which has excellent refrigerator clarity over extended periods of time. Specifically, refrigerator clarity of greater than 100 hours at 32° F and longer than 2 weeks at 40° F is considered acceptable.

The process of this invention may be operated in batch or in continuous fashion. In addition, it has been performed on refined and bleached oils provided that the free fatty acid content is within the stated ranges, but the soap in this process must then be removed before deodorization in order to form an acceptable salad oil.

EXAMPLE 1

A batch of sunflower oil was obtained. The oil was refined according to the process taught by U.S. Pat. No. 3,102,898 until analysis showed a free fatty acid content of 0.02% and a soap content of less than 0.05%. The batch of oil was divided into five portions which were labeled Samples A through E, respectively. Each sample was then identically processed with the single exception that a different sodium hydroxide concentration was used for each during dewaxing.

Each sample was chilled to 30° F and held for 3 hours. After the chilled time had expired, a dilute solution of sodium hydroxide was added to each sample. The dilute sodium hydroxide solution consisted of 1.5% by weight lye in water. The final oil to water ratio for each sample was 4:1 thus the water amounted to 20% by weight of the mixture. The dilute NaOH solution for each sample consisted of:

| WEIGHT PERCENTAGE OF ADDED ALKALI SOLUTION | |
|---|---|
| Sample A | 2.5% by weight of water phase |
| Sample B | 2.0% by weight of water phase |
| Sample C | 1.75% by weight of water phase |
| Sample D | 1.5% by weight of water phase |
| Sample E | 1.0% by weight of water phase |

Each sample was then agitated for 1 hour at 100 rpm with two 6-inch Marine impellers, said impellers providing mixing that was both low shear and high circulation. At this time a centrifuge was used to separate the heavy phase containing the wax from the light phase which was the purified oil. Each was bleached according to the process taught by U.S. Pat. No. 3,673,228 and deodorized according to the process of U.S. Pat. No. 3,506,969.

The samples were then tested for the amount of soap and water which had not been separated. The soap contents of Sample B, C and D were all found to contain less than the acceptable level of 0.03%. Samples A and E contained more than 0.03% soap and were judged unacceptable. Water levels were judged acceptable for all samples. In addition, 32° and 40° F chill tests were run. All samples were satisfactory at 32° F; but only Sample B, C and D were satisfactory at 40° F.

This example shows that the practice of the process of this invention is effective only in the concentration range of greater than 1.0% to less than 2.5% by weight lye in water.

EXAMPLE 2

An experiment was run using the same conditions as in Example 1 with the single exception being that agitation was at 200 rpm. Results obtained from 32° and 40° F chill tests showed that the increased rate of agitation caused the formation of an unsatisfactory clear oil product. The chill test time decreased with each successive increase in agitation rate. The conclusion was reached that mild agitation, i.e. less than 200 rpm, such that low shear and high circulation are produced and are essential to the successful operation of the process of this invention.

EXAMPLE 3

The procedure of Example 1 is repeated with the single exception being the samples are initially cooled to 40° F and held instead of 30° F. Slightly improved chill test results are obtained in comparison to those obtained by Example 1.

EXAMPLE 4

The procedure of Example 1 is repeated with the single exception being that the dilute alkali solution of 1.5% by weight of sodium bicarbonate in water. Substantially similar results to those obtained in Example 1 are found.

EXAMPLE 5

The procedure of Example 1 is repeated with the single exception being that the dilute alkali solution is composed of 0.17% by weight calcium hydroxide in water. Substantially similar results to those found in Example 1 are obtained.

EXAMPLE 6

The procedure of Example 1 is repeated with the single exception being that the dilute alkali solution is composed of 1.5% by weight ammomia in water. Substantially similar results to those found in Example 1 are obtained.

EXAMPLE 7

The procedure of Example 1 is repeated with the single exception being that the dilute alkali solution is composed of 0.12% by weight sodium oleate in water. Substantially similar results to those found in Example 1 are obtained.

What is claimed is:

1. A process for dewaxing vegetable oils comprising the steps of:

a. providing a vegetable oil prerefined until analysis of said oil shows less than 0.1% soap and less than 0.1% free fatty acid content, said oil being chilled to a temperature of less than about 60° F;

b. holding said refined oil at said temperature for longer than one hour;

c. mixing said refined vegetable oil of step (b) with an aqueous alkaline solution;

d. agitating in a low shear-high circulation manner the mixture of step (c) for at least ½ hour, to uniformly disperse the alkaline solution without forming an inseparable emulsion; and e. separating the agitated mixture to provide a wax-containing water phase and a dewaxed oil.

2. The process of claim 1 wherein the vegetable oil of step (a) contains less than 0.05% soap.

3. The process of claim 1 wherein the vegetable oil of step (a) contains less than 0.05% free fatty acid content.

4. The process of claim 1 wherein the oil temperature of step (a) is from about 30° to about 50° F.

5. The process of claim 1 wherein the oil temperature of step (a) is 40° F.

6. The process of claim 1 wherein the aqueous alkaline solution of step (c) comprises from about 10 to about 30% of the combined weight of vegetable oil and alkaline solution.

7. The process of claim 6 wherein the aqueous alkaline solution is sodium hydroxide in a concentration of from about 1 to about 2.5% by weight of sodium hydroxide in water.

8. The process of claim 1 wherein the agitation in step (c) is provided by two 6-inch marine impellers operated at about 100 rpm.

9. The process of claim 1 wherein the process is continuous.

10. The process of claim 1 wherein the process is conducted in batch fashion.

11. The process of claim 1 wherein the aqueous alkaline solution is a solution of a fatty acid soap.

12. The process of claim 1 wherein the aqueous alkaline solution is a solution of an alkali metal soap of from 8 to 22 carbon atoms.

13. The process of claim 12 wherein the aqueous alkaline solution is a solution of an alkali metal oleate.

14. A process for dewaxing vegetable oils previously refined and which contain waxes which precipitate at refrigerator temperatures comprising the steps of:

a. providing a vegetable oil pre-refined until analysis of said oil showed less than 0.05% soap and from about 0.01% to less than about 0.05% free fatty acid content, said oil being chilled to a temperature of about 30° to about 50° F, b. holding said refined oil at said temperature for longer than 1 hour;

c. diluting said refined vegetable oil of step (b) by admixing with from about 10 to 30% by weight of an aqueous alkali solution of about 1.5% by weight concentration of an alkali selected from the group consisting of sodium hydroxide, sodium bicarbonate, potassium hydroxide, calcium hydroxide, magnesium hydroxide and ammonia, d. agitating in a low shear-high circulation manner the mixture of step (c) for at least ½ hour, to uniformly disperse the alkali solution without forming an inseparable emulsion; and e. then centrifuging the agitated mixture to separate the wax-containing water phase and to provide a dewaxed oil in which the soap content is less than 0.03% by weight, water is less than 0.3%, and which oil after conventional blending and deodorization is suitable for use as a salad oil and has excellent refrigerator clarity of greater than 100 hours at 32° F and longer than 2 weeks at 40° F.

* * * * *